US005460376A

United States Patent [19]

Schmidt et al.

[11] Patent Number: 5,460,376

[45] **Date of Patent: * Oct. 24, 1995**

[54] HOLLOW, LARGE, METALLIC, GOLF CLUB HEAD

[75] Inventors: Glenn Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Apr. 12, 2011 has been disclaimed.

[21] Appl. No.: 263,970

[22] Filed: Jun. 19, 1994

Related U.S. Application Data

[63] Continuation-in-part of Ser. No. 173,389, Jan. 6, 1994, which is a continuation-in-part of Ser. No. 29,553, Mar. 11, 1993, Pat. No. 5,301,945, which is a continuation of Ser. No. 819,379, Jan. 15, 1992, Pat. No. 5,240,252, which is a continuation-in-part of Ser. No. 791,322, Nov. 14, 1991, Pat. No. 5,180,166, which is a continuation of Ser. No. 595,963, Oct. 16, 1990, Pat. No. 5,067,715.

[51] Int. Cl.[6] ..... A63B 53/04

[52] U.S. Cl. ..... 273/167 A; 273/174

[58] Field of Search ..... 273/167 A–167 E, 273/167 G, 167 H, 167 K, 172, 174, 167 F

[56] References Cited

U.S. PATENT DOCUMENTS

| | | |
|---|---|---|
| D. 94,549 | 2/1935 | Jansky . |
| D. 225,419 | 12/1972 | Mills . |
| D. 277,221 | 1/1985 | Kobayashi . |
| D. 307,783 | 5/1990 | Iinuma . |
| D. 318,087 | 7/1991 | Helmstetter . |
| D. 343,434 | 1/1994 | Helmstetter et al. . |
| 1,167,106 | 1/1916 | Palmer . |
| 1,485,685 | 3/1924 | McMahon . |
| 1,555,425 | 9/1925 | McKenzie . |
| 1,568,888 | 1/1926 | Dunn . |
| 1,582,836 | 4/1926 | Link . |
| 1,619,566 | 3/1927 | Crankshaw . |
| 1,658,581 | 2/1928 | Tobia . |
| 1,669,482 | 5/1928 | Miller . |
| 1,868,286 | 7/1932 | Grieve . |
| 1,916,792 | 7/1933 | Hadden . |
| 1,946,208 | 2/1934 | Hampton . |
| 1,968,626 | 7/1934 | Young . |
| 2,041,676 | 5/1936 | Gallagher . |
| 2,083,189 | 6/1937 | Crooker . |
| 2,087,685 | 7/1937 | Hackney . |
| 2,201,638 | 5/1940 | Theibault, Sr. . |
| 2,458,920 | 1/1949 | Wheeler et al. . |
| 2,460,435 | 2/1949 | Schaffer . |
| 2,960,338 | 11/1960 | Havey et al. . |
| 3,212,783 | 10/1965 | Bradley et al. . |

(List continued on next page.)

FOREIGN PATENT DOCUMENTS

| | | |
|---|---|---|
| 26072 | 9/1912 | United Kingdom . |
| 420332 | 11/1934 | United Kingdom . |
| 1476889 | 6/1977 | United Kingdom . |
| 2100993 | 1/1983 | United Kingdom . |
| 2225725 | 6/1990 | United Kingdom . |
| 2230459 | 10/1990 | United Kingdom . |

*Primary Examiner*—Vincent Millin
*Assistant Examiner*—Steven B. Wong
*Attorney, Agent, or Firm*—William W. Haefliger

[57] ABSTRACT

A golf club head comprising a shell having toe and heel portions, a rear wall, a front wall defining a ball-striking face, and top and bottom walls, the bottom wall characterized as having a medial ridge, and as forming two dished shallow recesses, one recess between the ridge and the heel portion, and the other recess between the ridge and the toe portion, the recesses spaced rearwardly from the front wall, the one recess having an arcuate peripheral edge generally convex toward the heel portion, and the other recess having an arcuate peripheral edge generally convex toward the toe portion, the recesses being located in substantially mirror imaged positions with respect to a forwardly extending vertical plane bisecting the ridge, the head, when viewed toward the bottom wall, presents a peripheral outline which, at the toe and rear of the head, has substantial spacing from the other dished shallow recess.

35 Claims, 6 Drawing Sheets

U.S. PATENT DOCUMENTS

| | | | |
|---|---|---|---|
| 3,625,518 | 12/1971 | Solheim . | |
| 3,761,095 | 9/1973 | Thompson . | |
| 3,976,299 | 8/1976 | Lawrence et al. . | |
| 4,214,754 | 7/1980 | Zebelean . | |
| 4,252,262 | 2/1981 | Igarashi . | |
| 4,313,607 | 2/1982 | Thompson . | |
| 4,332,388 | 6/1982 | Crow . | |
| 4,417,731 | 11/1983 | Yamada . | |
| 4,429,879 | 2/1984 | Schmidt . | |
| 4,432,549 | 2/1984 | Zebelean . | |
| 4,438,931 | 3/1984 | Motomiya . | |
| 4,511,145 | 4/1985 | Schmidt . | |
| 4,681,321 | 7/1987 | Chen et al. . | |
| 4,872,685 | 10/1989 | Sun . | |
| 4,930,781 | 6/1990 | Allen . | |
| 5,000,454 | 3/1991 | Soda . | |
| 5,028,049 | 7/1991 | McKeighen . | |
| 5,042,806 | 8/1991 | Helmstetter . | |
| 5,067,715 | 11/1991 | Schmidt et al. . | |
| 5,163,682 | 11/1992 | Schmidt et al. . | |
| 5,180,166 | 1/1993 | Schmidt et al. . | |
| 5,240,252 | 8/1993 | Schmidt et al. . | |
| 5,301,945 | 4/1994 | Schmidt et al. ..... | 273/167 A |

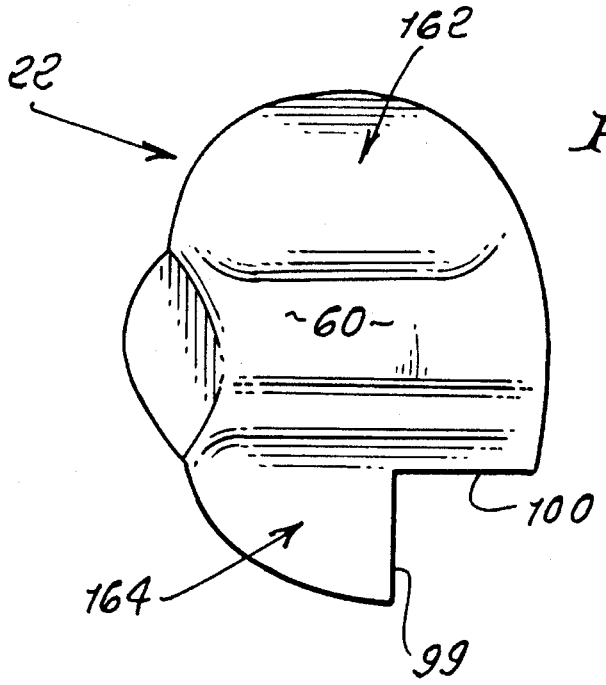
FIG. 11.
FIG. 12.
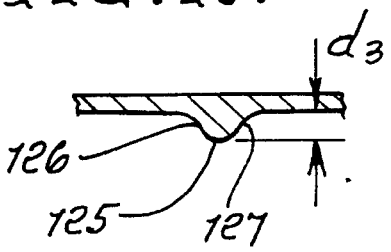
FIG. 13.
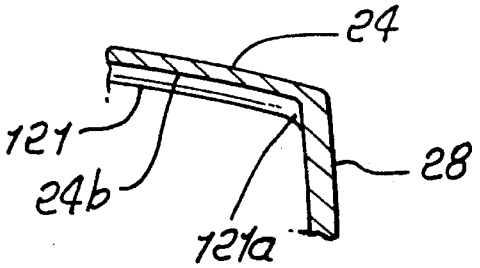
FIG. 14.
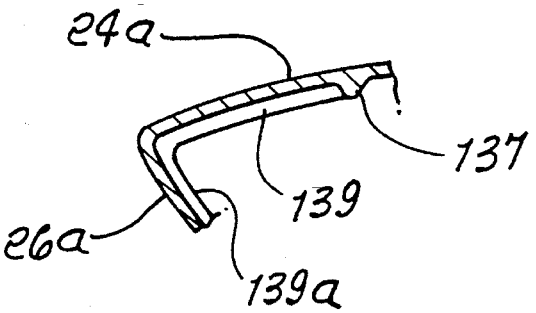

HOLLOW, LARGE, METALLIC, GOLF CLUB HEAD

BACKGROUND OF THE INVENTION

This application is a continuation-in-part of Ser. No. 08/173,389, filed Jan. 6, 1994, which is a continuation-in-part of Ser. No. 08/029,553, filed Mar. 11, 1993, now U.S. Pat. No. 5,301,945 which is a continuation of Ser. No. 07/819,379, filed Jan. 15, 1992, now U.S. Pat. No. 5,240,252 issued Aug. 31, 1993, which is a continuation-in-part of Ser. No. 07/791,322, filed Nov. 14, 1991, now U.S. Pat. No. 5,180,166 issued Jan. 19, 1993, which is a continuation of Ser. No. 07/595,963, filed Oct. 16, 1990, now U.S. Pat. No. 5,067,715 issued Nov. 26, 1991.

This invention relates generally to increasing the size of metallic, hollow, golf club heads (woods) without increasing head weight to facilitate ball stroking accuracy. Also, it concerns configuring an enlarged head in such manner as to resist deflection of the front wall and to absorb shock waves at top, bottom, and rear walls.

Very large, very thin-walled, metal, golf club heads present problems of cracking and buckling of metal walls, and excessive front wall deflection, during ball impact. There is need to provide an improved metal head construction and/or configuration which guides, interrupts, spreads, or otherwise alters the shock waves which emanate from the face at impact, but while maintaining reduced wall thicknesses.

There is also need to strengthen the thinned walls and/or sole plates, of such golf club heads, as well as to reduce drag forces at such bottom walls during stroking.

SUMMARY OF THE INVENTION

It is a major object of the invention to provide structure overcoming the above problems and disadvantages. Basically, the improved head of the invention is characterized by a ball striking front wall, a bottom wall, and spaced toe and heel walls, the bottom wall characterized as having two shallow recesses, one recess closer to the heel portion, and the other recess closer to the toe portion, the recesses being spaced rearwardly from the front wall, one recess having an arcuate peripheral edge generally convex toward the heel portion, and the other recess having an arcuate peripheral edge convex toward the toe portion.

Such recesses typically have downwardly facing surfaces with shallow, upwardly dished configuration. The downward facing surfaces are concave in front-to-rear directions; and the downward facing surfaces are also concave in directions between the heel and toe.

Another object is to provide a head which, when viewed toward the bottom wall, presents a peripheral outline which, at the toe and rear of the head, has substantial spacing from the other dished shallow recess. As will be seen, the spacing between the peripheral outline at the toe and the other dished recess is typically at least ⅝ inch; and the spacing between that outline at the head rear and other dished recess is at least about 1 inch. These large spacings, defined by arcuate slopes of head wall portions, contribute to head wall strengthening, to enable head enlargement.

A further object is to provide a head with a peripheral outline, as referred to, and which encompasses an area A, and the dished recesses, ridge and bevel define an area B, when viewed toward the bottom wall of the head, and where A>1.6 B. Typically, A is related to B by the expression $1.7<A/B<2.0$.

Another object is to provide bottom wall localized structure that will aid in "digging out" a golf ball having a bad lie from the turf.

Another object is to provide such a head wherein the bottom wall has a bevel that extends at a rearwardly and upwardly extending angle, beyond rearward extent of a medial ridge, and between rearward extents of the localized recesses. That bevel may merge with peripheries of the dished recesses, as will appear. The bevel is spaced at least ¾ inch from the rear periphery of the head, as viewed toward the bottom wall of the head.

A further object is to provide the bottom wall to be in part defined by a sole plate having a peripheral edge rigidly connected to the bounding edge of an opening defined by the bottom wall, rearwardly of the front wall, whereby the sole plate closes the opening, the medial ridge and recesses also being in part defined by the sole plate. In this regard, the sole plate typically defines major extents of the shallow recesses. A head body shell may also define a rigidizing bottom wall corner plate section integral with shaft supporting tube structure, the sole plate also connected to that corner plate section, the corner plate section also forming a portion of the one shallow recess closest to the head heel portion.

Yet another object is to provide a first group of narrow, metallic, shock wave distributing dendrites extending from the front wall generally rearwardly adjacent the underside of the shell top wall and integral therewith, the dendrites projecting toward the two shallow recesses, the bottom wall defining those recesses being upwardly concave toward the dendrites.

A second group of dendrites may also be provided to be integral with the top wall and spaced apart to extend generally rearwardly to merge rearwardly and downwardly with a rear wall defined by the shell to transfer rearward loading to that wall as the dendrites pick up rearward loading from the top wall in response to front wall impact with a golf ball, the second group of dendrites also projecting toward the two shallow recesses.

The dendrites are such as to transfer, spread, dampen, and distribute impact-produced shock so as to reduce shock wave concentration otherwise imposed on the junction between the front wall and top wall. Shock waves are produced by high speed impact of the club head with the golf ball, which leaves the head about ½ millisecond after impact, for a driver with head traveling at 100 miles per hour. The dished walls of the plate also strengthen the structure for shock load transmission.

It is another object to provide hosel structure that extends downwardly into the head interior and forms a shaft-receiving opening. This strengthens the connection of the front wall to the dished sole plate and heel, and reduces hosel weight, so that such weight can be utilized to form the dendrites, as referred to. In this regard, the invention enables the provision of a larger overall volume head, as compared with the head of the same weight, but lacking the dendritic structure, as referred to. As will be seen, the use of such structure enables thinning of the hollow head top, toe, back, and heel walls.

Another object is to provide a head bottom wall which controls engaged turf relative movement (during a golf swing) so as to create upward force or force acting on the head in a manner resulting in reduced drag as the head is swung.

Another object is to provide a set of golf club heads, each head comprising a shell having toe and heel portions, and a front wall defining a ball striking face, and top or bottom walls, the ball striking faces of the heads having varying angularities with respect to vertical, the bottom wall of each head having a medial ridge, and forming two dished, similar shallow recesses, one recess between the ridge and heel portion and the other recess between the ridge and toe portion, such recesses located rearwardly of the front wall, one recess having an arcuate peripheral edge portion generally convex toward the heel portion and the other recess having an arcuate peripheral edge portion generally convex toward the toe portion. Each recess of each head may have a downwardly facing surface further characterized in that, for each head, i) a vertical plane bisecting the recess in a toe-to-heel direction intersects the recess surface along a downwardly concave line, and ii) a vertical plane bisecting the recess in a front-to-rear direction relative to the head intersects the recess surface along a downwardly concave line.

Also, the two concave recesses of each head typically have similar configuration with respect to a vertical plane that bisects the ridge in a front-to-rear direction relative to the head. Further, each recess of each such head may have a downwardly facing surface further characterized in that, for each head, i) the rearwardmost extent of the downwardly facing surface is inclined forwardly and upwardly relative to the head forward swing path as the head bottom wall engages the turf, ii) whereby lift force is created in response to engagement of the rearwardmost extent of the surface with the turf, as the head is swung forwardly along the path, such lift force acting to urge the head bottom wall and the head in an upward direction.

Yet another object is to provide for each head a bottom wall having a rearwardly divergent surface (which may be locally flattened) that extends at a rearwardly and upwardly extending angle, beyond rearward extent of the ridge, and between rearward extents of the recesses, for reducing drag as the head is swung forwardly in an arc, adjacent the turf. In this regard, guided engagement with the turf and upward force exertion are enhanced by a configuration wherein the rearwardly divergent surface and the two recesses have edges which, when viewed from the rear of the head, are upwardly convex. Also, for each head, there may be provided a substantially continuous, hollow, metallic tube extending within the shell of the heel portion and from proximate the shell top wall to proximate the shell bottom wall, that tube having a bore to receive a club shaft, the bore aligned with the one shallow recess.

A further object is to provide a set of heads, as referred to, which includes at least two or more of the following:

a) a metal wood having a front face inclined at approximately 9° from vertical, b) a metal wood having a front face inclined at approximately 11° from vertical, c) a metal 2 wood, d) a metal 4 wood, e) a metal 5 wood.

Yet another object of the invention is to provide a set of heads characterized by one of the following:

a) at least one head has a center of gravity located at approximately 42% to 50% of the head height, as measured upwardly from the lowermost head surface to the uppermost head surface, viewed from the front of the head, b) each of at least two of the heads has a center of gravity located at approximately 42% to 50% of the head height as measured upwardly from the lowermost head surface to the uppermost head surface, viewed from the front of the head.

A still further object is to provide an improved golf club head, and method of forming same, to incorporate components in construction, mode of operation and results, when used, as referred to.

These and other objects and advantages of the invention, as well as the details of an illustrative embodiment, will be more fully understood from the following specification and drawings, in which:

DRAWING DESCRIPTION

FIG. 11 is a plan view of the sole plate that fits into the bottom opening shown in FIG. 10;

FIG. 12 is a fragmentary section showing dendrite structure;

FIG. 13 is a fragmentary section showing dendrites extending rearwardly from the head front wall;

FIG. 14 is a fragmentary section showing dendrites extending rearwardly downwardly adjacent the top and rear walls of the head;

DETAILED DESCRIPTION

Figure 1:
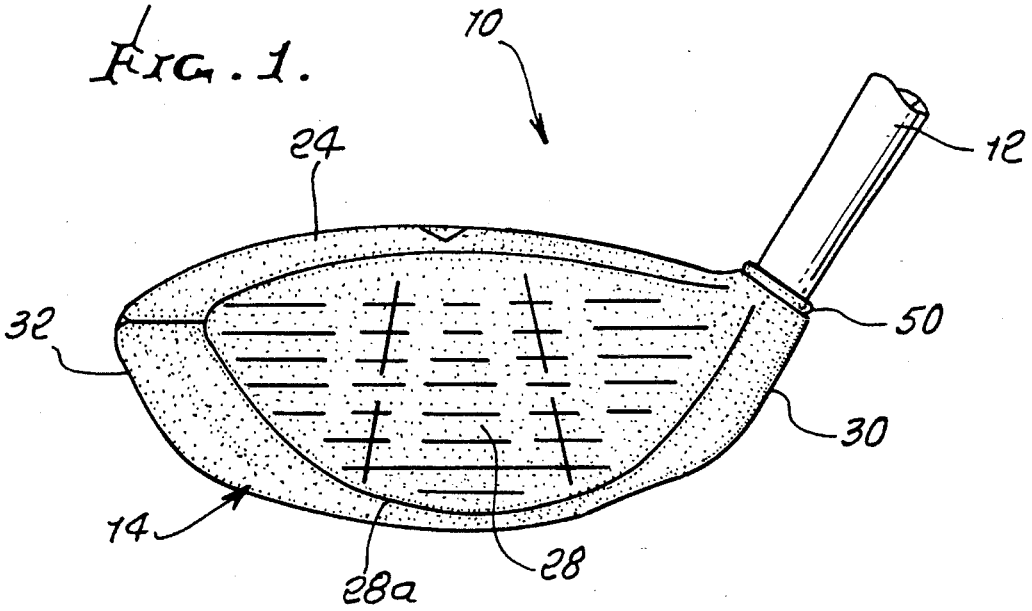
FIG. 1 is a front elevational view of a golf club head incorporating the invention.

Referring now to the drawings, a golf club 10, in accordance with a preferred embodiment of the present invention, is shown. The club 10 includes a shaft 12 (only the lower portion of which is shown), which is attached to a head 14. The head 14 is in the configuration of a "wood" club, although it is made of metal. As shown in FIGS. 6–9, the head comprises a hollow, metal shell 16, which is filled with a plastic foam filling 18, preferably polyurethane.

The shell 16 is preferably made of titanium or titanium alloy; and it may be fabricated by the "lost wax" casting method that is well known in the art. The shell 16 is formed in two pieces: a main portion 20 and a sole plate 22 that is peripherally welded to the main portion 20, and as will be referred to. See weld locations at **22*a* and 22*b* in FIG. 6**.

The main shell portion 20 has a top surface 24, a rear surface 26, and a ball-striking surface or face 28 opposite the rear surface 26. The face 28 is angled with respect to the vertical with a specified "pitch" that is determined by the type of club and the amount of loft desired. The end portion of the head 14, proximate the shaft 12, is commonly termed the "heel" 30; while the end portion, opposite the heel 30, is termed the "toe" 32.

Figure 2:
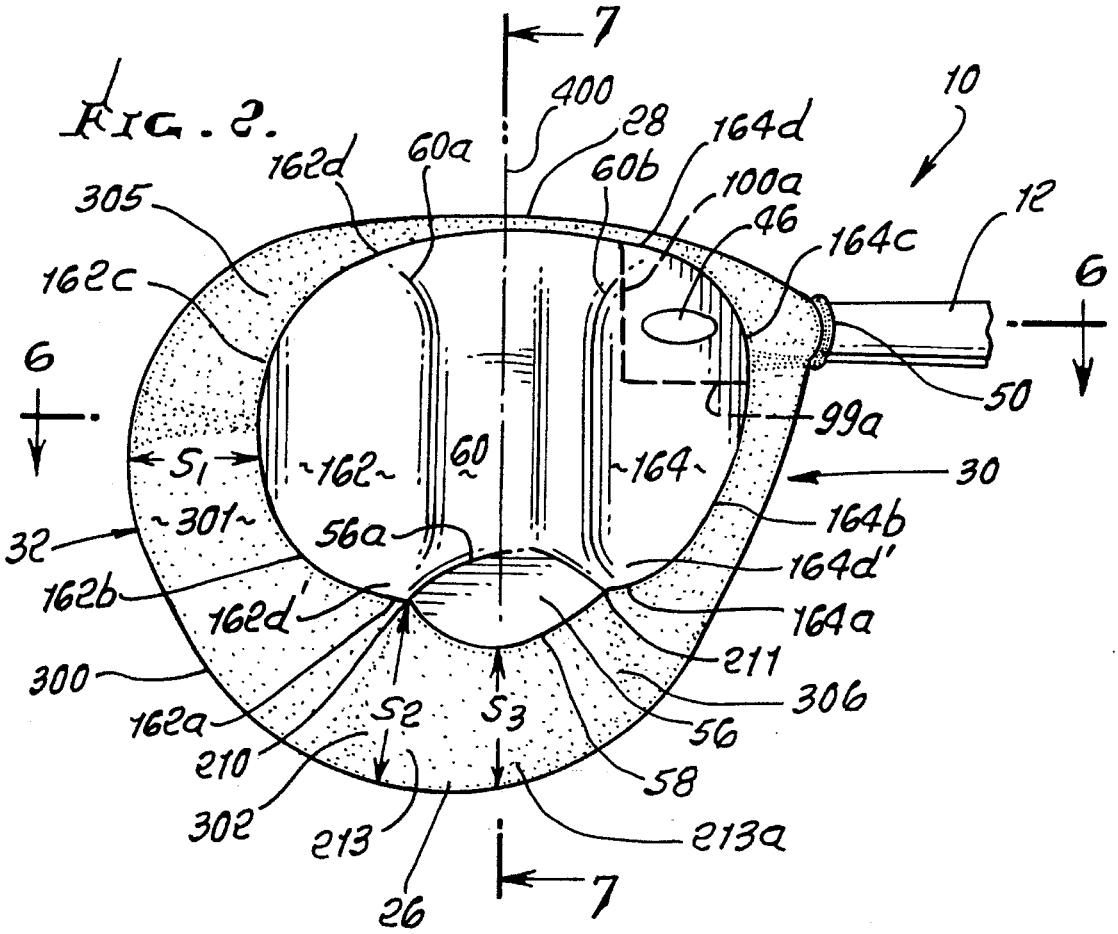
FIG. 2 is a plan view of the bottom of the FIG. 1 head.

As shown in FIG. 2, the face 28 is typically curved from the heel 30 to the toe 32. The main shell portion 20 has a bottom corner portion 34 (shown in FIG. 10) that is cast integrally with the front wall 28*a* and with the heel wall 30*a*, and flush with the sole plate 22, that forms a bottom surface or sole in combination with the sole plate 22 when the two shell portions are welded together.

Figure 6:
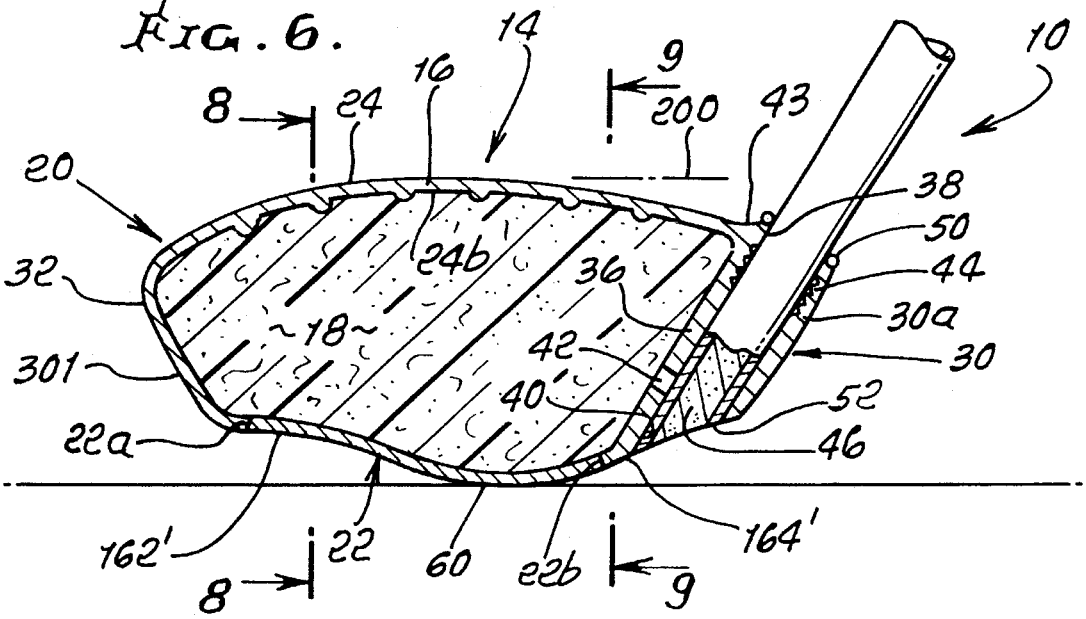
FIG. 6 is an elevation taken in section on lines 6—6 of FIG. 2.
Figure 7:
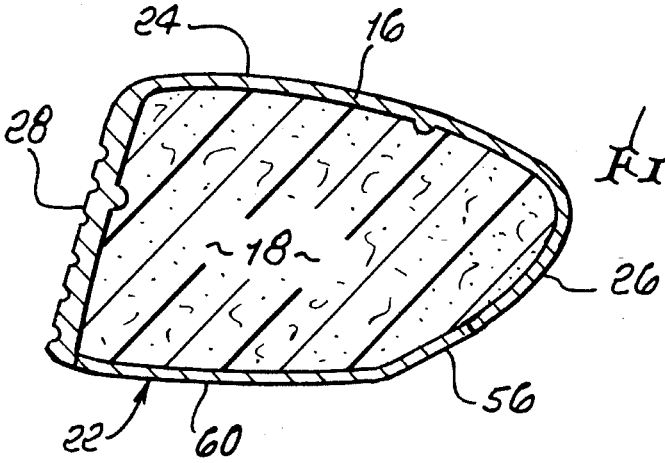
FIG. 7 is an elevation taken in section on lines 7—7 of FIG. 2.
Figure 8:
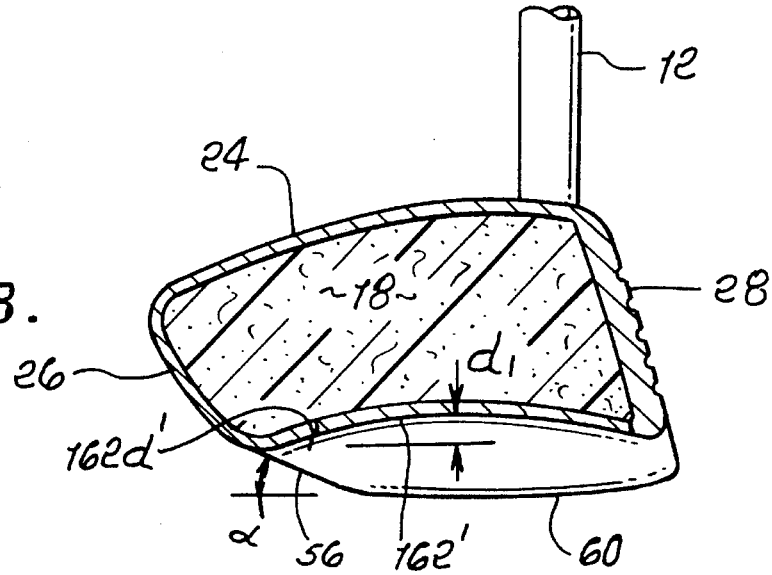
FIG. 8 is an elevation taken in section on lines 8—8 of FIG. 6.
Figure 9:
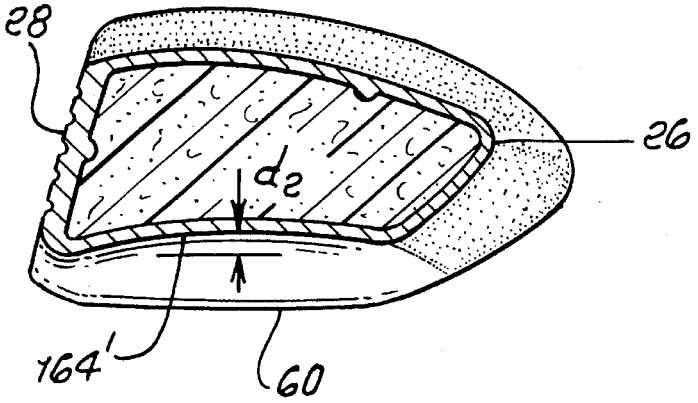
FIG. 9 is an elevation taken in section on lines 9—9 of FIG. 6.

Referring now to FIG. 6, the heel wall 30*a* of the shell 16 is provided with a substantially continuous hollow tube 36 that extends from an upper opening 38 in the top surface 24 to a lower elliptical opening 40 in the bottom surface or sole through the bottom corner portion 34 of the main shell portion 20. The tube 36 is of substantially uniform internal diameter; and its side wall is interrupted by an internal orifice 42 that opens into the interior of the shell. The orifice 42 provides an entrance for the introduction of the foam material 18 into the hollow shell interior during the manufacturing process.

The tube 36 is dimensioned to receive the lower part of the shaft 12 with a snug fit. The upper opening 38 is provided with a radiused lip 43, as shown in FIG. 6, to minimize the possibility of stress fractures in the shaft, due to impact against the edge of the opening. A portion of the interior wall of the tube 36, extending downwardly from the upper opening 38, may be provided with striations, preferably in the form of internal threads, or a series of concentric steps 44, to provide a "glue lock" for better bonding of the shaft in the tube.

In the preferred embodiment of the invention, the lip 43 is at the end of a slight rise at the heel end of the head, the height of the rise being slightly less than, or approximately equal to, the height of a horizontal plane 200 defined by the highest point of the club head top surface 24.

The shaft 12 is a hollow tube made of any suitable material. Steel is the most common material, but titanium and graphite-boron may also be used. If the shaft is of steel, the exterior of the shaft may be chrome-plated to minimize corrosion. The lower part of the shaft may be fitted with a plug 46 to prevent the entry of moisture into the interior of the shaft. The plug 46 may be of any suitable resilient material, such as Nylon, epoxy, polyurethane, or Delrin. The plug 46 may be retained in the shaft by an annular crimp in the shaft wall. The crimp also serves as a glue lock. A locator ring 50, preferably of glass fiber-reinforced Nylon, is adhesively bonded to the shaft at a distance above the bottom end 52 of the shaft, approximately equal to the length of the tube 36.

The shaft 12 may be attached to the head 14 by a suitable epoxy adhesive, the steps or threads 44 in the tube 36 and the crimp in the shaft providing glue locks, as mentioned above, for better adhesive bonding. (Any plating on the lower part of the shaft is first buffed off.) During assembly, the lower part of the shaft is inserted into the tube 36 until the locator ring 50 abuts against the radiused lip 43 at the upper tube opening 38. The bottom end 52 of the shaft 12 then extends slightly beyond the lower tube opening 40. This bottom end 52 is then cut and ground so as to be flush with the sole of the head, as shown in FIG. 6.

The structure described above allows the shaft to be attached to the head without a neck or hosel. As a result, substantially all of the mass of the head is "effective mass" that contributes to the transfer of energy from the player to the ball, with little or no "deadweight" to reduce the attainable club head velocity. By increasing the effective mass of the club head without reducing the attainable velocity, there is a more effective transfer of energy to the ball from the player, yielding increased shot distance without an increase in effort on the part of the player.

Moreover, without an external hosel, the lower part of the shaft may extend all the way through the head, with the bottom end 52 of the shaft terminating flush with the sole. Thus, by eliminating the external hosel, the shaft both enters, and may exit, the head, within the area defined between the top and bottom of the face of the club head, which area is sometimes called the "ball control zone". By bringing the lower end of the shaft within the control zone, and extending the shaft deeply into the head shell, for example through to the sole of the club head, the tactile sense of the location of the club face, or "head feel", is maximized, yielding increased control of the shot, greater ability of the skilled player to "work" the ball, and a more solid feel of impact with the ball regardless of where on the face the ball is struck. The increase in effective mass of the club head, and the rigid support for the lower end of the shaft, provided by the internal tube 36 in which the lower end of the shaft is received, further contribute to this improvement in "head feel".

Furthermore, a number of advantages in the manufacturing process can be achieved by eliminating the hosel. For example, the mass that would have been taken up by the hosel can be redistributed to a part of the club head where it can contribute to the effective mass of the head without increasing the total head mass. Optimally, this mass can be added by increasing the overall size of the club head.

Still another advantage of eliminating the hosel is that there is a more even cooling of the club head in the mold. Where there is an upward hosel, by comparison, the hosel and the rest of the club head shell may cool at unequal rates, thereby resulting in a slight warping that can produce a lack of uniformity in loft, lie, and face angle from club head to club head.

A golf club, in accordance with a preferred embodiment of the invention, includes the sole configuration shown in the drawings. As shown in the drawings, the bottom wall is characterized as forming a medial ridge 60, and as forming two shallow recesses, one recess between the ridge and the heel portion, and the other recess between the ridge and the toe portion, the recesses everywhere spaced rearwardly from the front wall, the one recess having an arcuate peripheral edge generally convex toward the heel portion, and the other recess having an arcuate peripheral edge generally convex toward the toe portion. Examples of such shallow, upwardly dished recesses are seen at 162 between the ridge 60 and the toe 32, and at 164 between the ridge and heel 30.

Recess 162 curved periphery extends in a looping edge path, indicated at 162*a*, 162*b*, 162*c*, and 162*d*. Recess 164 also extends in a looping edge path indicated at 164*a*, 164*b*, 164*c*, and 164*d*, both paths located on the bottom wall, as shown. The maximum depth of each recess below a plane containing its peripheral looping edge path is less than ¼ inch, and preferably between 1/16 inch and 3/16 inch. See depths $d_1$ and $d_2$ in FIGS. 8 and 9. These depths are sufficient normally to avoid direct frictional contact of recess dished innermost surfaces 162' and 164' with the ground during a club stroke, ground contact, if any, being confined to the lowermost extent of the central ridge 60, and to recess peripheral or rearward wall extents, as will appear.

Also, the upward bi-directional concavity of the bottom wall extents 162' and 164' forming the recesses adds to bottom wall strength, and stiffness, for transmitting shock loading transmitted to and from the front wall 28 during ball stroking. The bottom wall thickness may then be minimized and metal "redistributed", to enable provision of a larger sized head.

Note also the provision of a bottom wall rearwardly divergent surface, or bevel, which extends at a rearwardly and upwardly extending angle, beyond rearward extent of the ridge, and between rearward extents of the recesses.

Specifically, there is a trailing, beveled surface 56, which is a relieved, upwardly angled, somewhat flattened portion extending upwardly from a curved edge **56*a*, and between that edge and the center of the sole, and a trailing edge 58 at the juncture between the rear surface 26 of the club head and the sole plate 22. The lowermost curved part 56*a* of the surface 56 is contiguous with the rearward end of ridge 60 that extends forward toward and diverges at 60*a* and 60*b* to merge laterally with the bottom U-shaped lower edge 28*a* of the face 28 of the club head, edge 28*a*** being addressed toward the turf, as the head is swung.

The trailing surface or bevel 56 preferably extends at an angle $\alpha$ of approximately 18° to 25° with respect to the horizontal. See FIG. 8. The angle $\alpha$ may be varied by plus or minus up to about 5°, depending on the type of club and the preference of the player. The trailing surface 56 minimizes the club head's closing, or "hooding", when the ball is hit "fat", while reducing the overall aerodynamic drag of the club head to maximize its attainable velocity during the swing.

Further, in regard to the described combination of bottom wall contours, the ridge downward curvature rearwardly of the front face, and between the dished recesses 162 and 164 enables the sole to penetrate the turf, resisting and repelling the turf against the dished out zones 162 and 164 to limit penetration in proportion to or accordance with the unique shape of the sole as a unit, in a unique way, the front face having a downward U-shape forward of the recesses and ridge, as is clear from FIGS. 1 and 2. Note the ridge diverging forwardly toward the U-shaped front face.

Accordingly, a golf ball having a "bad lie" can be approached in a confident way, to "dig" the ball out by means of a club stroke characterized in that the club head sole planes over the turf, considering the turf as fluid. For a golf ball having a more conventional lie, no "digging out" is required, and an improved downward sole shape "footprint" is produced on the turf, as will be referred to.

Figure 10:
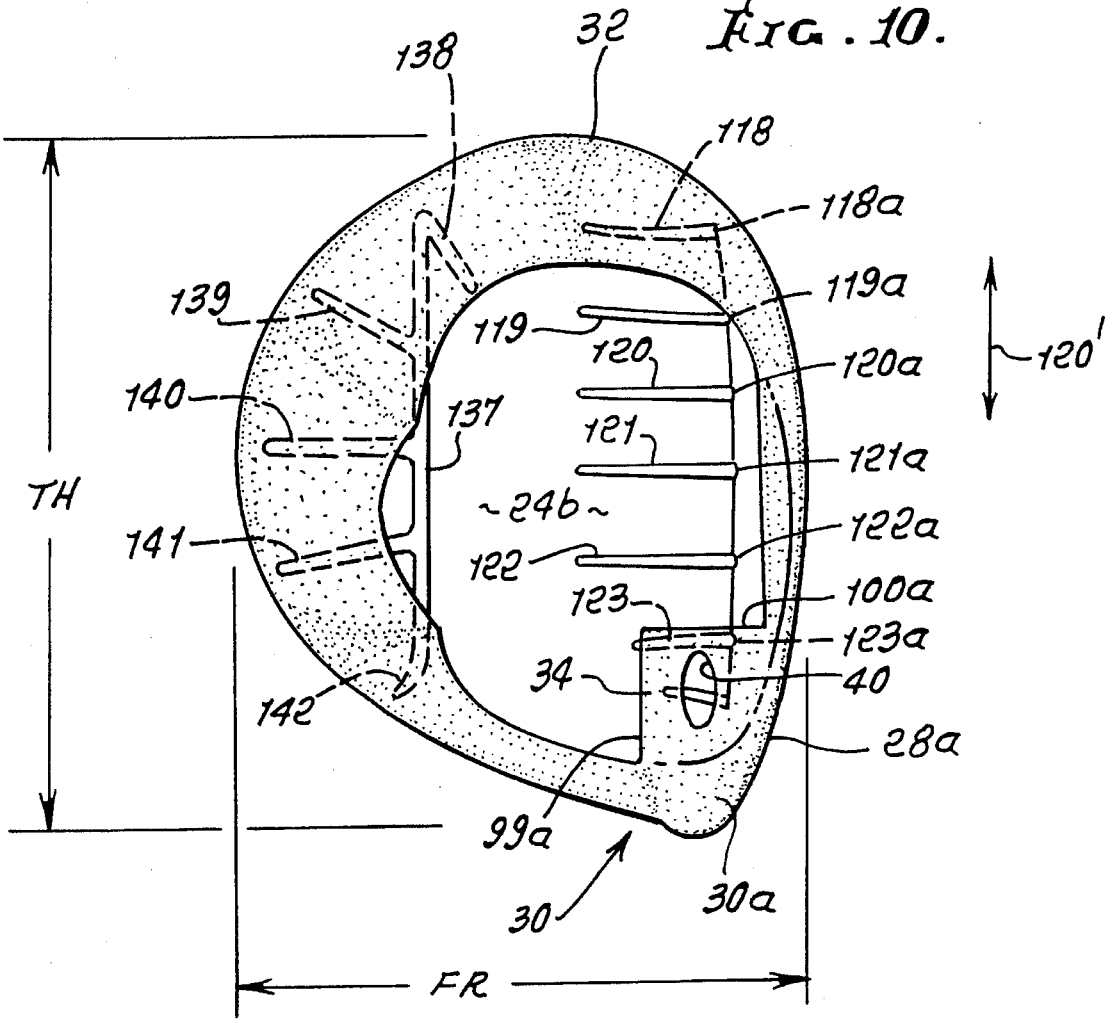
FIG. 10 is a plan view showing the bottom of the FIG. 1 head, but prior to attachment of a sole plate.
Figure 15:
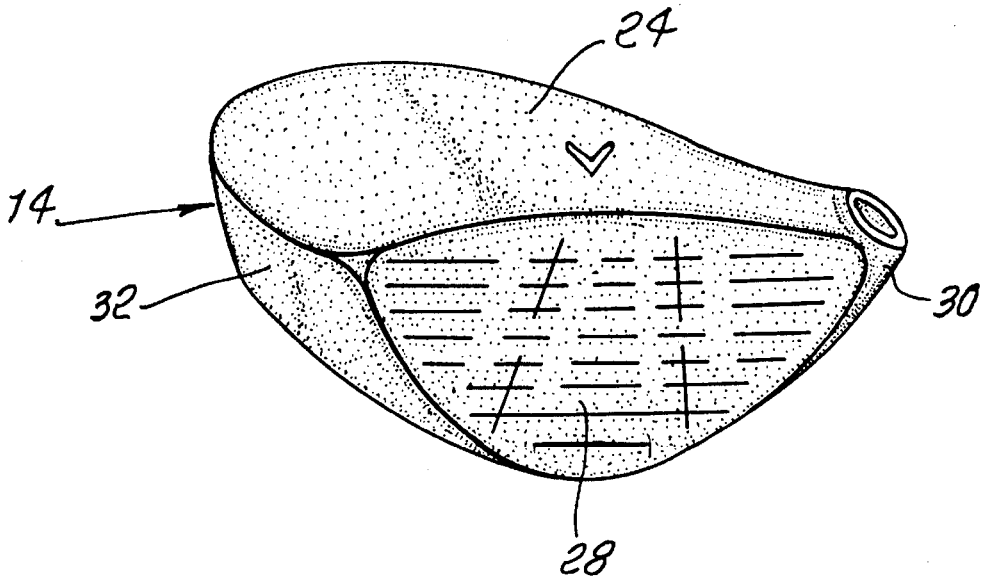
FIG. 15 is a perspective view of the FIG. 1 head.
Figure 16:
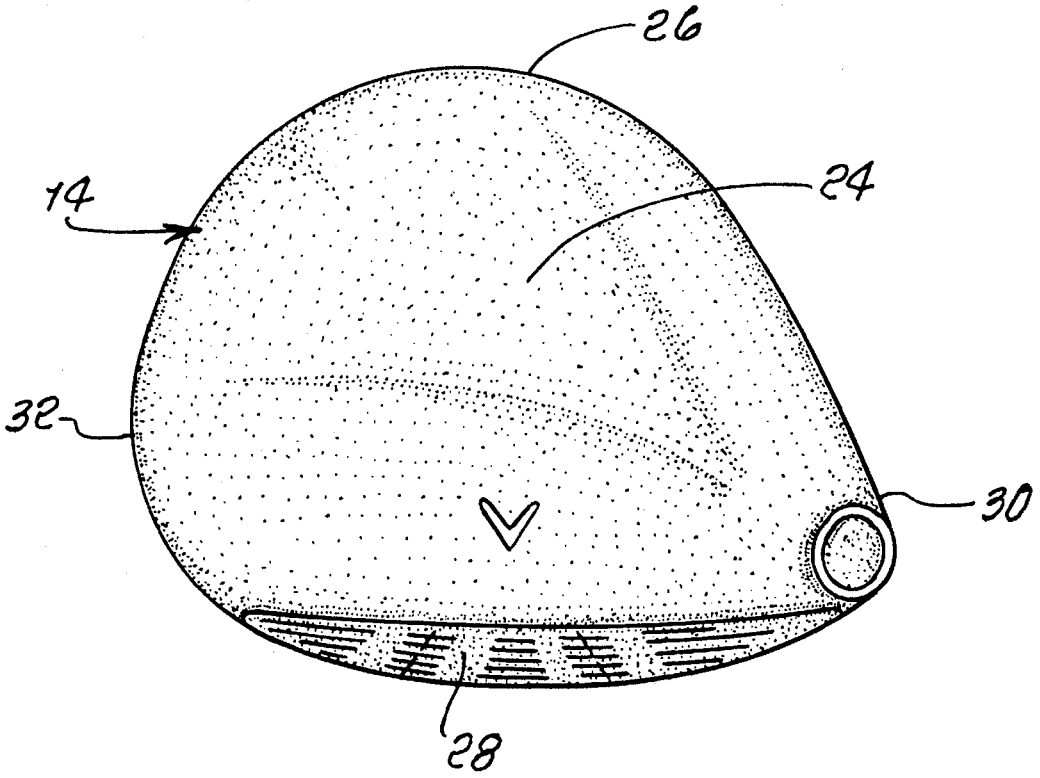
FIG. 16 is a top plan view of the FIG. 1 head.

Referring to FIGS. 6, 10, and 11, hosel tube 36 extends downwardly into the hollow interior of the heel portion of the head and is adapted to receive a shaft 12. Thus, the weight of the hosel is concentrated more directly behind, or close to, the rear side of front wall 28, near the heel, to contribute to the ball-striking mass of the front wall. Also, the hosel cylindrical wall reinforces the junction of the front wall, bottom wall, and heel wall. See also rigidizing hosel webbing or filleting 34, which forms the corner plate section of the bottom wall 22. Corner section also forms a portion of the dished portion of the bottom wall recess 164. When the sole plate is attached to the shell, a weld may be formed along edges 99 and **99*a*, and 100 and 100*a*. See FIGS. 10 and 11**.

In accordance with another important aspect of the invention, a first group or set of narrow, metallic dendrites is provided to extend from the front wall 28 generally rearwardly adjacent the underside **24*b* of the top and upper wall 24*a* and integral therewith. See in the example dendrites 118–123 spaced apart in a transverse direction, indicated by arrows 120' the dendrites having forward ends 118*a*–123*a* merging into the front wall at its junctions with the top wall. Note the possible widening of the dendrites as they merge with front wall 28. This serves the purpose of distributing impact-produced shock or stress waves from the front wall to the top wall, especially when a ball is hit high on the front wall or face. This in turn serves to prevent cracking and buckling of the thin, metal, top wall 24**. Note that the dendrites are spaced apart, i.e., branch, at intervals of about ½ to ¾ inch; and that the rearward ends of the dendrites are transversely spaced apart.

The vertical dimension $d_3$ of the dendrites lies within the range 0.050 to 0.070 inch; and the dendrites are generally convex at 125 toward the interior of the head, along their lengths, and have concave opposite sides at 126 and 127 (see FIG. 12). In this regard, and as referred to above, the thickness of the front wall is typically substantially greater than the thickness of the other walls, to strengthen it and prevent cracking under high impact loads.

Typical wall approximate thicknesses are: front wall 0.120 inches (maximum), sole plate 0.050 inches (maximum) excluding possible local thickening projecting from front face intersection with the sole plate, and top wall 0.030 inches. The dimensions are less than standard thicknesses, allowing for a larger head and a larger moment of inertia for a given total weight. This in turn allows a greater "forgiveness effect" as regards off-center ball strikes. Reduced thicknesses may be maintained despite head extreme enlargement by casting the head of titanium or titanium alloy, which is lighter than steel.

Further, the conformation of the dendrites 118– 123 (see FIG. 13) along their lengths, to head interior wall shape, contributes to shock wave distribution across the upper wall 24. Note that wall 24 may be upwardly crowned, i.e., upwardly shallowly convex. The top wall may therefore have reduced thickness.

Also provided is a second set or group of narrow, metallic dendrites extending generally rearwardly adjacent the underside of the top wall and integral therewith, the second set also including a transversely extending dendrite intersecting the generally rearwardly extending dendrites of the second set. The dendrites of the second set are located further from the head front wall than the first set of dendrites; the rearwardly extending dendrites of the second set being spaced apart, or branching, in transverse direction, the vertical dimensions of the second set dendrites also being between 0.050 and 0.100 inches. See for example the five dendrites 138–142 that have fan configuration, radiating rearwardly from different points along the single transverse dendrite 37 spaced rearwardly from dendrites 118–123.

Dendrites 138–142 extend generally rearward to merge with the generally curved rear wall **26*a* of the head, to direct or transfer such rearward loading to that wall as the dendrites pick up loading from top wall 24*a*. See FIG. 14**.

Dendrites 137–142 have generally the same configuration and dimensions as dendrites 118–123. Accordingly, they serve the same shock or stress wave transfer-distributing functions, to minimize cracking and buckling of the thinned top wall at its junction at 146 with the rear wall. Note also that dendrites 137–142 conform to top wall shape along their lengths. See FIG. 14. In addition, the rearward ends of the dendrites 137– 142 turn downwardly and forwardly adjacent the inner side of rear wall 26*a*, as seen at 139*a* in FIG. 14, for example. This strengthens the rear wall, allowing reduction in rear wall thickness.

The dendrites project generally toward the upwardly dished walls 162' and 164', so that both top and bottom walls are stiffened to transmit shock loading rearwardly, whether the ball strikes the front wall 28 relatively upwardly thereon, or at a lower portion thereof.

A further important aspect of the invention concerns the provision of a golf club head having a metal shell defining top, bottom, front, rear, toe, and heel walls, and wherein:

a) the bottom wall has upwardly dished wall extent, b) the upwardly dished wall extent defining downward facing surface means inclined forwardly and upwardly relative to the head swing path as the bottom wall engages the turf, so that the turf moving relatively rearwardly engages the inclined surface means for creating lift force, acting to urge the bottom wall and the head in an upward direction, whereby drag is reduced and more kinetic energy is available for transfer to the ball.

Further, and as described, the bottom wall also has a downward facing medial ridge 60 which extends generally forwardly, the dished wall extent preferably including two dished extents 162 and 164, respectively, located at opposite sides of the ridge, each of the two dished extents defining a portion of the inclined surface means (at the rears of dished extents 162 and 164), whereby upward lift forces are developed at opposite sides of the ridge, for torsionally balanced upward lift imparted to the head.

Finally, the turf controlling head bottom wall can be formed or cast integrally with the remainder of the head, if desired, i.e., it need not be separately formed and later welded to a rim defined by a separately cast head. Such forming may be by a casting or molding process employing metallic or non-metallic material.

Further, and as shown, the two recesses of each head have similar configuration with respect to a vertical plane 400 that bisects ridge 60 in a front-to-rear direction relative to the head. See FIGS. 2 and 7.

Figure 3:
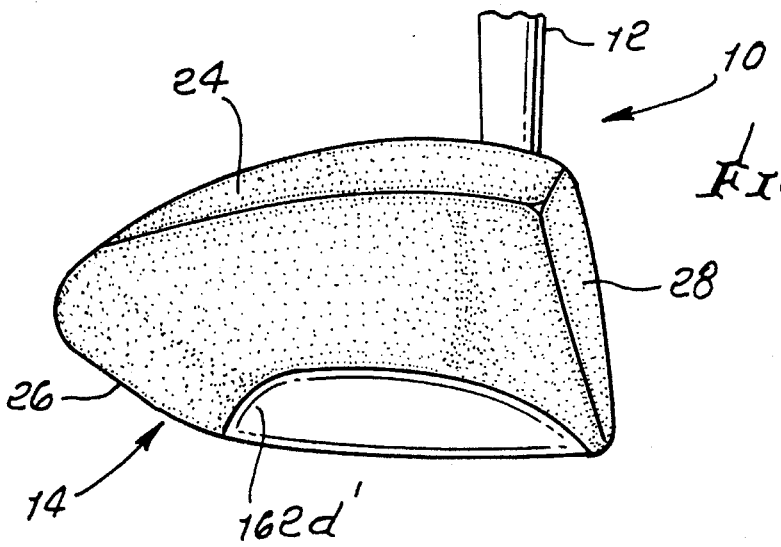
FIG. 3 is an elevational view of the toe end of the FIG. 1 head.
Figure 4:
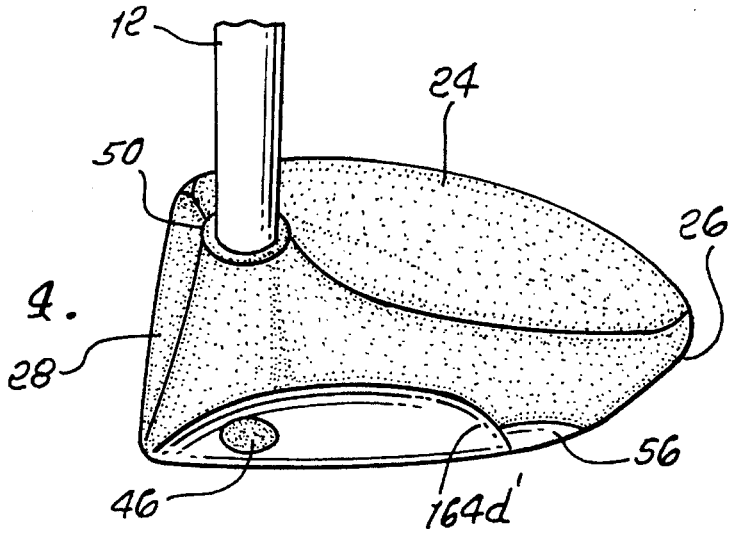
FIG. 4 is an elevational view of the heel end of the FIG. 1 head.

It will also be seen that each recess has a downward facing surface and is further characterized in that:

i) the rearwardmost extents 162*d'* and 164*d'* of the downwardly facing surfaces are inclined forwardly and upwardly relative to the head forward swing path as the head bottom wall engages the turf (see FIGS. 3 and 4), ii) whereby balanced lift forces are created in response to engagement of the rearwardmost extents of the surfaces with the turf as the head is swung forwardly along the path, such lift forces acting to urge the head bottom wall and the head in an upward direction.

The bottom wall and/or the rest of the head can be made of materials other than metal, but metal, such as titanium, is preferred for a very large head.

As used herein, the word "turf" shall be understood to mean grass, weeds, sand, mud, and other material engageable and displaceable by the bottom wall of the head.

Figure 5:
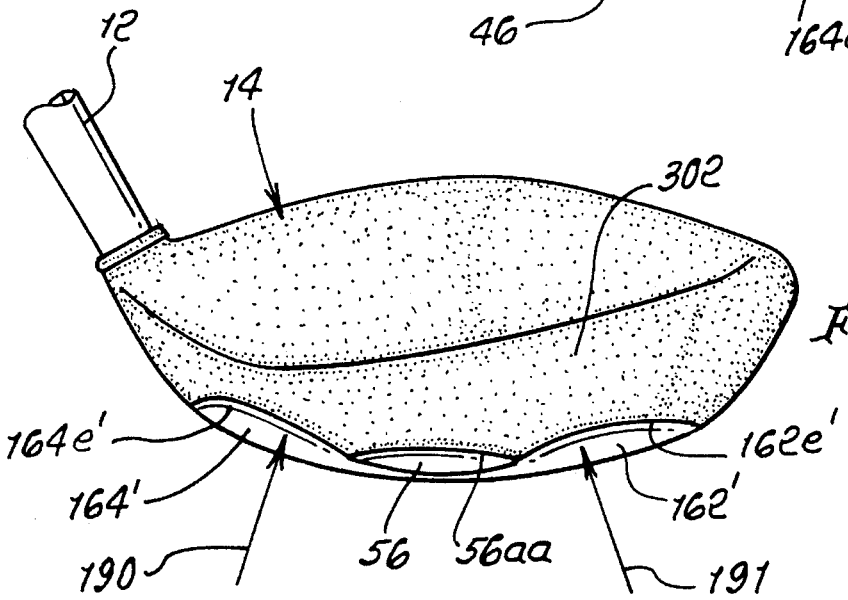
FIG. 5 is a rear elevation view of the FIG. 1 head.

Referring to FIG. 5, the recesses 162' and 164' have edges 162*e'* and 164*e'* which, when viewed from the rear of the head, are upwardly convex. The rearward edge 56*aa* of flattened beveled surface 56 is also upwardly convex in FIG. 5 and located approximately midway between edges 162*e'* and 164*e'*. Such convex edges extend in an arcuate row, as seen in FIG. 5, and define a V-shape. Upward lift force vectors appear at 190 and 191, and result from engagement of the inclined rear portions of the inclined rear portions of the dished recess surfaces with the turf, as referred to above. Note that the vectors are angled upwardly and toward one another.

Referring again to FIG. 2, the head is further characterized by the following:

i) the dished recesses 162 and 164 are located in substantially mirror imaged position with respect to a forwardly extending, vertical plane 400 bisecting the ridge 60;

ii) the convergent rearward terminus of dished recess rearwardmost extent 162*d'* is intersected by a cusp 210 defined by angled surface or bevel 56; and the convergent rearward terminus of dished recess rearwardmost extent 164*d'* is intersected by a cusp 211 also defined by bevel 56. These cusps are further defined by intersection of the bevel with head convexly rounded or arcuate outer bottom surface 213 and intersection of the bevel with the ridge rearwardmost and rearwardmost divergent extents, as shown. The cusps 210 and 211 are substantially equidistant from the head front face 28, whereby the bevel 56 is centered between the rearwardmost extents 162*d'* and 164*d'* of the recesses;

iii) plane 400 also bisects the bevel so that cusps 210 and 211 are located at substantially equal distances from that plane; and the plane 400 also intersects the rearwardmost extent 213*a* of the head.

The above features also contribute to the balanced lift force creation discussed above.

Referring again to FIG. 2, it will be seen that the illustrated very large metal head, when viewed toward the bottom wall, presents a peripheral outline which, at the toe and rear of the head, has substantial spacing from the other dished shallow recess. See peripheral outline 300, which at the toe of the head, has spacing $S_1$ from recess 162; and at the rear of the head has spacing $S_2$ from recess 162. $S_1$ is typically at least about ⅝ inch and may preferably be about ¾ to ⅞ inch; and $S_2$ is at least about 1 inch, and may preferably be about 1 to 1 ⅜ inch, in the plane in which the bottom wall is viewed, as in FIG. 2.

These relatively large spacings, provided for a large metal wood head, contribute to strengthening as needed for a very thin wall construction, since the associated walls of the head have extended convexly sloping or arcuate extent, i.e., . . . "tumble home". See walls at 301 associated with $S_1$, and walls at 302 associated with $S_2$.

Further, the spacing $S_3$ between overall peripheral outline 300 and the rear bevel 56, as viewed in FIG. 2, is at least about ¾ inch, for the very large head shown; and the head surface 213*a* associated with $S_3$ slopes upwardly and outwardly from the bevel 56 toward outline 300.

Further, for the very large head shown, the peripheral outline 300 encompasses an area A, as viewed in FIG. 2; and the dished recess 162 and 164, ridge 60, and bevel 56 define an outline encompassing an area B, where: $A>1.6\,B$, thereby defining an important feature of the very large head; i.e., the elements 162, 164, 60, and 56 are relatively localized, with respect to the overall peripheral size of the head. Preferably, A and B are related as follows: $1.7<A/B<2.0$. Strengthening of the thin-walled head is obtained by providing relatively large areas of tumble home, as referred to at 301, 302, 213*a*, and as also shown at 305 and 306. Typical head dimensions, as seen in FIG. 10, are:

TH (toe to heel)=about 4 ⅜ inches

FR (front to rear)=about 3 ¾ inches

The head top and rear walls have thickness of about 0.055 inch; and the front wall has thickness at its center of about 0.130 inch and tapering toward end portions near the heel and toe of thickness about 0.110 inch. The sole has thickness of about 0.070 inch.

Metal woods between 1 and 7 sizes, i.e., with varying front wall angularities, may be provided incorporating the invention herein; and a set of such woods may be provided, the invention herein extending to such a set. Each head has a center of gravity located at approximately 42% to 50% of the head height, as measured upwardly from the lowermost head surface to the uppermost head surface, viewed from the front of the head.

From the above and as shown in the drawings the medial ridge as, for example, at 60 faces downwardly during striking of a ball, and is spaced below the levels of the dished recesses as at 162 and 164. Also, the ridge is seen as in FIG. 8 to have rearwardly elongated length at substantially the same elevation. FIG. 6 shows the ridge 60 to be downwardly convex in a toe to heel direction along its length, to define ridge sidewalls merging with the recesses 162 and 164. FIG. 2 shows the ridge 60 as diverging endwise.

The contents of all applications of which the present application is a continuation, or a continuation-in-part, are incorporated herein, by reference.

We claim:

1. A golf club head comprising a heel having toe and heel portions, a rear wall, a front wall defining a ball-striking face, and top and bottom walls, said bottom wall characterized as having a medial ridge, and as forming two dished shallow recesses, one recess between the ridge and the heel portion, and the other recess between the ridge and the heel portion, and the other recess between the ridge and the toe portion, said recesses spaced rearwardly from said front wall, the one recess having an arcuate peripheral edge generally convex toward said heel portion, and the other recess having an arcuate peripheral edge generally convex toward the toe portion, said recesses being located in substantially mirror imaged positions with respect to a forwardly extending vertical plane bisecting said ridge, the head, when viewed toward said bottom wall, presenting a peripheral outline which, at the toe and rear of the head, has substantial spacing from said other dished shallow recess, said medial ridge being a downwardly facing medial ridge spaced below the levels of said recesses, said ridge having rearwardly elongated length at substantially the same elevation and being downwardly convex in a toe to heel direction along said length thereof to define ridge side walls merging with said recesses, said ridge diverging endwise.

2. The club head of claim 1 wherein said spacing between said peripheral outline at the toe and said other dished recess is at least about ⅝ inch.

3. The club head of claim 1 wherein said spacing between said outline at the head rear and said other dished recess is at least about 1 inch.

4. The club head of claim 1 wherein said medial ridge increases in width toward said front wall and between forward extents of said recesses.

5. The club head of claim 1 wherein said bottom wall has a bevel that extends at a rearwardly and upwardly extending angle, beyond rearward extent of said ridge, and between rearward extents of said recesses.

6. The club head of claim 5 wherein said spacing between said outline at the head rear and said bevel, as viewed toward the head bottom wall, is at least about ¾ inch.

7. The club head of claim 1 wherein the head has downwardly facing surfaces which slope upwardly and outwardly from said other dished recess toward said peripheral outline, as viewed toward the head bottom wall.

8. The club head of claim 5 wherein said peripheral outline encompasses an area A, and said dished recesses, ridge and bevel define an area B, when viewed toward the bottom wall of the head, and where $$A>1.6B.$$

9. The club head of claim 8 where $$1.7<A/B<2.0$$

10. The club head of claim 1 wherein said recesses have downward facing surfaces with shallow upwardly dished configuration.

11. The club head of claim 1 wherein said bottom wall is in part defined by a sole plate having a peripheral edge rigidly connected to the bounding edge of an opening defined by said bottom wall, whereby the sole plate closes said opening, said ridge and recesses being in part defined by the sole plate.

12. The club head of claim 1 wherein said recesses have surfaces that merge in arcuate relation with opposite sides of said ridge.

13. The club had of claim 1 wherein said front wall has lowermost U-shaped configuration, forwardly of said ridge and recesses.

14. The club head of claim 1 having a substantially continuous, hollow, metallic tube extending within the shell of the heel portion and from proximate the shell top wall to proximate the shell bottom wall, said tube having a bore to receive a club shaft, said bore aligned with said one shallow recess.

15. The club head of claim 10 wherein said downward facing surfaces are concave in front-to-rear directions.

16. The club head of claim 15 wherein said downward facing surfaces are also concave in directions between the heel and toe.

17. The club head of claim 5 wherein said bottom wall includes a sole plate peripherally connected to a shell rim defining a bottom opening, said sole plate defining major extents of said shallow recesses.

18. The club head of claim 5 wherein said bottom wall includes a sole plate peripherally connected to a shell rim defining a bottom opening, said sole plate defining major extents of said shallow recesses, said sole plate also defining said ridge and said bevel.

19. The club head of claim 14 wherein said bottom wall includes a sole plate peripherally connected to a shell rim defining a bottom opening, said sole plate defining major extents of said shallow recesses, said shell defining a bottom wall corner plate section integral with said tube, said sole plate also connected to said corner plate section, said corner plate section forming a portion of said one shallow recess between said ridge and heel portion.

20. The club head of claim 1 including a first group of narrow, metallic, shock wave distributing dendrites extending from said front wall generally rearwardly adjacent the underside of the shell top wall and integral therewith, said dendrites projecting toward said two shallow recesses.

21. The club head of claim 20 including a second group of dendrites integral with said top wall and which are spaced apart, and which extend generally rearwardly to merge rearwardly and downwardly with a rear wall defined by the shell to transfer rearward loading from said top wall in response to front wall impact with a golf ball, said second group of dendrites also projecting toward said two shallow recesses.

22. The club head of claim 21 wherein the dendrites of each group are spaced apart in a toe-to-heel direction.

23. A golf club head having a metal shell defining top, bottom, front, rear, toe, and heel walls, and including a) dendrites integral with the inner sides of said top and rear walls, and b) the bottom wall having two upwardly dished wall sections projecting toward the dendrites integral with the top wall, and spaced between the heel and toe, one dished wall section defining one recess relatively closer to the toe and the other dished wall section defining another recess relatively closer to the heel, c) the head, when viewed toward said bottom wall, presenting a peripheral outline which, at the toe and rear of the head, has substantial spacing from said other dished shallow recess, d) said bottom wall having a downwardly facing medial ridge space below the levels of said recesses, said ridge having rearwardly elongated length at substantially the same elevation and being downwardly convex in a toe to heel direction along said length thereof to define ridge side walls merging with said recesses, said ridge diverging endwise.

24. A club head of claim 1 wherein the ridge co-acts with said recesses during a club stroke to direct the turf toward and into the recesses, the recesses having surfaces inclined forwardly and upwardly to be engaged by the turf moving relatively rearwardly, for creating lift forces at opposite sides of the ridge, urging the bottom wall and head in an upward direction.

25. The head of claim 5 wherein the head has a center of gravity located at approximately 42% to 50% of the head height, as measured upwardly from the lowermost head surface to the uppermost head surface, viewed from the front of the head.

26. The club head of claim 1 which is metallic and comprises titanium.

27. The club head of claim 8 which is metallic and consists essentially of titanium.

28. The club head of claim 26 wherein at least one of said head walls has minimum thickness less than about 0.060 inch.

29. The club head of claim 1 wherein said top wall has thickness of about 0.055 inch, and said front wall has minimum thickness less than about 0.130 to 0.110 inch.

30. The golf club head comprising a metallic shell having toe and heel portions, a rear wall, a front wall defining a ball stoking face, and top and bottom walls, the bottom wall characterized as having localized undulant and angled surfaces delineated within a first peripheral outline for turf engagement and for urging the head upwardly in response to turf engagement, the head, when viewed toward said bottom wall, presenting a second peripheral overall outline having substantial spacing from said first peripheral outline at least toward said toe and toward the club rear, the club head shell sloping arcuately upwardly and outwardly between said first and second outline, the bottom wall defining a downwardly facing medial ridge and two shallow recesses at opposite sides of the ridge, said ridge spaced below the levels of said recesses, said ridge having rearwardly elongated length at substantially the same elevation and being downwardly convex in a toe to heel direction along said length thereof to define ridge side walls merging with said recesses, said ridge diverging endwise.

31. The head of claim 30 wherein said first peripheral outline encompasses an area B, and said second peripheral outline encompasses an area A, where $$A>1.6B.$$

32. The head of claim 31 wherein $$1.7<A/B<2.0.$$

33. The head of claim 1 having a center of gravity located at approximately 42% to 50% of the head height, as measured upwardly from the lowermost head surface to the uppermost head surface, viewed from the front of the head.

34. A set of golf club heads, each head having a configuration, as defined in claim 1.

35. The set of heads, as defined in claim 34, wherein each head has a center of gravity located at approximately 42% to 50% of the head height, as measured upwardly from the lowermost head surface to the uppermost head surface, viewed from the front of the head.

* * * * *

UNITED STATES PATENT AND TRADEMARK OFFICE

CERTIFICATE OF CORRECTION

PATENT NO. : 5,460,376

DATED : Oct. 24, 1995

INVENTOR(S) : Glenn H. Schmidt & Richard C. Helmstetter

It is certified that error appears in the above-indentified patent and that said Letters Patent is hereby corrected as shown below:

On the title page, [22] Filed: Jun. 19, 1994 should read --[22] Filed: June 29, 1994--

Signed and Sealed this

Fifteenth Day of April, 1997

*Attest:*

Bruce Lehman

BRUCE LEHMAN

*Attesting Officer*

*Commissioner of Patents and Trademarks*